US005884687A

United States Patent [19]

Schwarzkopf

[11] Patent Number: 5,884,687

[45] Date of Patent: Mar. 23, 1999

[54] HEATED-CHAMBER DIE-CASTING APPARATUS

[75] Inventor: Eugen Schwarzkopf, Lüdenscheid, Germany

[73] Assignee: Hotset Heizpatronen U. Zubehor GmbH, Ludenscheid, Germany

[21] Appl. No.: 821,661

[22] Filed: Mar. 19, 1997

[30] Foreign Application Priority Data

Mar. 22, 1996 [DE] Germany ..... 196 11 267.2

[51] Int. Cl.[6] ..... B22D 17/26; B22D 35/06

[52] U.S. Cl. ..... 164/342; 164/312; 222/593

[58] Field of Search ..... 164/342, 312; 222/593

[56] References Cited

U.S. PATENT DOCUMENTS 5,350,159 9/1994 Parker ..... 222/593

5,448,678 9/1995 Booton ..... 222/593

FOREIGN PATENT DOCUMENTS 6-47515 2/1994 Japan ..... 164/312

*Primary Examiner*—Patrick Ryan
*Assistant Examiner*—I.-H. Lin
*Attorney, Agent, or Firm*—Herbert Dubno; Andrew Wilford

[57] ABSTRACT

A die-casting apparatus has a pair of mold parts together defining a mold cavity and a feed sleeve set in one of the parts and defining a passage having a short inner portion opening into and flared toward the cavity, a long outer portion of uniform cross-sectional shape and having an outer end, and a restriction between the portions. Molten metal is fed to the outer end and through the passage to the cavity. A heater surrounds the sleeve at the outer portion for heating the sleeve substantially only at the outer portion and insulation surrounds the heater. The sleeve and any metal therein are cooled at a location in the sleeve downstream of the passage outer portion, normally at the restriction.

8 Claims, 1 Drawing Sheet

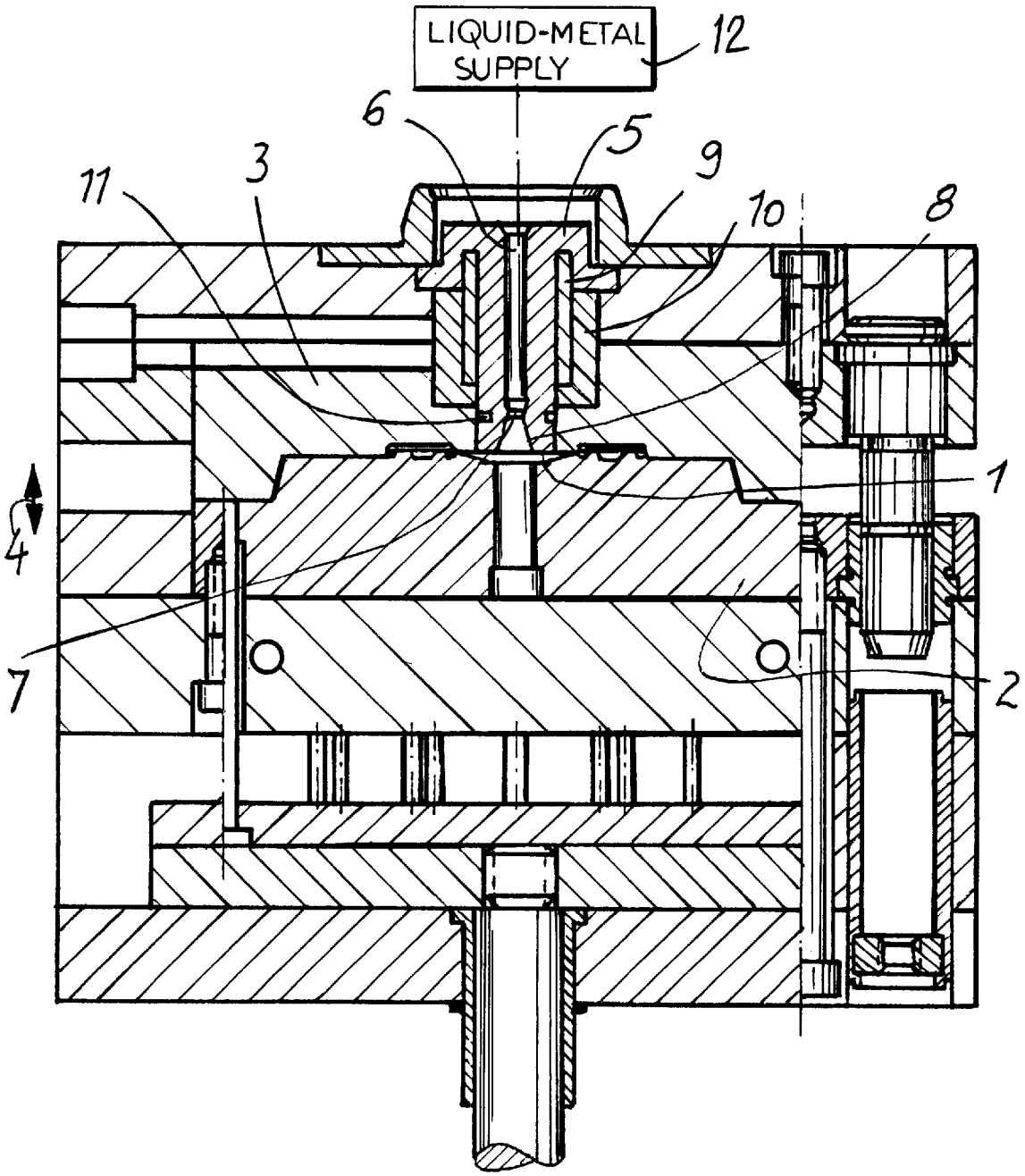
LIQUID-METAL SUPPLY
12
6
5
9
11
3
10
8
1
4
7
2

HEATED-CHAMBER DIE-CASTING APPARATUS

FIELD OF THE INVENTION

The present invention relates to a casting apparatus. More particularly this invention concerns a die-casting machine used for making cast zinc bodies.

BACKGROUND OF THE INVENTION

A standard die-casting apparatus has a pair of mold parts together defining a mold cavity and a feed sleeve set in one of the parts and defining a passage opening into the cavity. Molten metal is fed through the passage to the cavity.

Normally the sleeve feed passage is basically frusto-conical, flared along its full length toward the passage. To hold back the molten metal when the mold is opened, the small-diameter outer end, right at the injector nozzle of the metal-supplying machine, is cooled so as to form a small plug. When the workpiece has solidified and is knocked out of the mold cavity, the hardened metal in the passage therefore separates at this cooled region, leaving the workpiece carrying a long outwardly tapering sprue corresponding in shape to this passage. This sprue must be removed, typically with a separate grinding operation that is fairly laborious as the sprue is rather large. The metal of this sprue is frequently contaminated by the grinding operation so it cannot be recycled. Furthermore the mold cycling time is increased by the amount of time it takes this extra mass of metal to harden, and of course heat energy is wasted melting the metal of this sprue which is not used.

OBJECTS OF THE INVENTION

It is therefore an object of the present invention to provide an improved die-casting machine.

Another object is the provision of such an improved die-casting machine which overcomes the above-given disadvantages, that is which produces as small a sprue as possible.

SUMMARY OF THE INVENTION

A die-casting apparatus has according to the invention a pair of mold parts together defining a mold cavity and a feed sleeve set in one of the parts and defining a passage having a short inner portion opening into and flared toward the cavity, a long outer portion of uniform cross-sectional shape and having an outer end, and a restriction between the portions. Molten metal is fed to the outer end and through the passage to the cavity. A heater surrounds the sleeve at the outer portion for heating the sleeve substantially only at the outer portion and insulation surrounds the heater. According to the invention the sleeve and any metal therein are cooled at a location in the sleeve down-stream of the passage outer portion.

Such an apparatus produces a workpiece having a very small sprue, corresponding to the short flared inner portion of the feed passage. Thus grinding off this formation is relatively easy. Less metal is wasted and less energy is used melting and cooling the sprue. The metal held in the longer outer portion stays molten and only the small plug at the restriction, which is easily driven out and liquefied in the next molding operation, is hard. This plug holds back the molten metal above it when the mold is opened and the workpiece is ejected.

The temperature in the long cylindrical outer portion of the passage is held, for zinc, at 420° C. while the temperature at the restriction is at about 390° C. This produces an exactly controlled separation location for the sprue on demolding of the workpiece.

According to the invention the means for cooling is an air gap. Normally the sleeve is formed with a radially open groove forming the air gap and the groove is level with the restriction.

BRIEF DESCRIPTION OF THE DRAWING

The above and other objects, features, and advantages will become more readily apparent from the following description, reference being made to the accompanying drawing whose sole figure is a partly diagrammatic and partly sectional view of the apparatus of this invention.

SPECIFIC DESCRIPTION

As seen in the drawing a molding apparatus has a mold cavity 1 defined between a movable mold part 2 and a fixed mold part 3 that are closable together as indicated by vertical arrow 4. A feed sleeve 5 has an outer end connected to a supply 12 of liquid metal and a passage formed by a relatively long outer portion 6, a restriction 7 and a frusto-conically flared inner portion 8 opening into the cavity 1, the portion 6 having a length about three times that of the portion 8. This sleeve 5 is surrounded by an electrical sleeve heater 9 of the type described, for example, in commonly owned patent U.S. Pat. No. 5,591,367 and is surrounded by a tubular insulation sleeve 10.

The metal from the supply 12 is zinc and the heater 9, which is positioned wholly above the restriction 7, maintains the outer portion 6 at a temperature above the melting point of 419° C. of zinc. Thus the metal is always molten in the outer portion 6.

The sleeve 5 is formed with an air gap constituted by an outwardly open annular groove 11 level with the restriction 7. This formation ensures that there is a thermal break in the sleeve 5 so that the inner passage portion can have a temperature of about 390° C., below the melting point of zinc.

Thus once the cavity 1 is filled the metal in it and in the portion 8 and restriction 7 will solidify. When the workpiece is demolded, a sprue corresponding to the flared portion 8 will remain with the workpiece while a short plug of solidified metal will remain in the restriction 7. When the mold 2, 3 is again closed and more metal is fed from the supply 12 to the outer portion 6, the plug will be pushed out and melted as the cavity and portion 8 are again filled with liquid metal which will solidify as described above.

I claim:

1. A die-casting apparatus comprising:

a pair of mold parts together defining a mold cavity;

a feed sleeve set in one of the parts and defining a passage having a short inner portion opening into and flared toward the cavity, a long outer portion of uniform cross-sectional shape and having an outer end, and a restriction between the portions;

means for feeding molten metal to the outer end and through the passage to the cavity;

means including a heater surrounding the sleeve at the outer portion for heating the sleeve substantially only at the outer portion;

insulation surrounding the heater; and means including structure generally at the restriction for cooling the sleeve and any metal therein downstream of the passage outer portion.

2. The die-casting apparatus defined in claim 1 wherein the structure is an air gap.

3. The die-casting apparatus defined in claim 1 wherein the long outer portion is of cylindrical shape.

4. The die-casting apparatus defined in claim 1 wherein the long outer portion is about three times as long as the short inner portion.

5. The die-casting apparatus defined in claim 1 wherein the heater is an electrical sleeve heater.

6. The die-casting apparatus defined in claim 1 wherein the metal is zinc and the heater maintains the outer portion above 419° C.

7. A die-casting apparatus comprising:

a pair of mold parts together defining a mold cavity;

a feed sleeve set in one of the parts and defining a passage having a short inner portion opening into and flared toward the cavity, a long outer portion of uniform cross-sectional shape and having an outer end, and a restriction between the portions;

means for feeding molten metal to the outer end and through the passage to the cavity;

means including a heater surrounding the sleeve at the outer portion for heating the sleeve substantially only at the outer portion;

insulation surrounding the heater; and means including a radially open groove formed in the sleeve and forming an air gap for cooling the sleeve and any metal therein downstream of the passage outer portion.

8. The die-casting apparatus defined in claim 7 wherein the groove is level with the restriction.

* * * * *